US005577800A

United States Patent [19]

Earl, Jr.

[11] Patent Number: 5,577,800

[45] Date of Patent: Nov. 26, 1996

[54] ADJUSTABLE WORK SEAT TO PROVIDE SUPPORT WHEN IN A KNEELING POSITION

[76] Inventor: Lionel F. Earl, Jr., 361 Prutt Cir., Gunter Air Force Base, Ala. 36115

[21] Appl. No.: 184,372

[22] Filed: Jan. 21, 1994

[51] Int. Cl.[6] ..... B60N 2/38

[52] U.S. Cl. ..... 297/195.11; 297/187; 297/174; 297/423.11; 297/423.12

[58] Field of Search ..... 297/195.11, 217.7, 297/174, 187, 311, 344.1, 344.18, 411.21, 423.11, 423.12, 337

[56] References Cited

U.S. PATENT DOCUMENTS

| | | | |
|---|---|---|---|
| 1,170,396 | 2/1916 | Bech | 297/423.11 X |
| 2,069,476 | 2/1937 | Keil | 297/423.11 X |
| 4,589,699 | 5/1986 | Dungan | 297/423 |
| 4,746,167 | 5/1988 | Palmer et al. | 297/195.11 X |
| 4,937,897 | 7/1990 | Barnabie | 297/187 X |

FOREIGN PATENT DOCUMENTS

| | | | |
|---|---|---|---|
| 449588 | 7/1948 | Canada | 297/423.12 |
| 2502487 | 10/1982 | France | 297/187 |
| 2098060 | 11/1982 | United Kingdom | 297/187 |
| 8403614 | 9/1984 | WIPO | 297/174 |

*Primary Examiner*—Laurie K. Cranmer
*Attorney, Agent, or Firm*—Peter Loffler

[57] ABSTRACT

A work seat is provided for use when in a kneeling position. The work seat has a base which has a soft resilient material on its top surface for receiving the user's knees. The seat can be moved backward and forward along the base. The height and the pitch of the seat can be adjusted. An optional elbow or arm rest is provided. The elbow or arm rest can be height adjusted. Optional wheels are provided for the base. The bottom of the base has a non-slip layer.

8 Claims, 7 Drawing Sheets

ADJUSTABLE WORK SEAT TO PROVIDE SUPPORT WHEN IN A KNEELING POSITION

BACKGROUND OF THE INVENTION

Many routine functions require a person to be in a kneeling position. These functions include washing a person or pet in a bath tub, working on the body of a car, gardening, etc. In a kneeling position, a substantial portion of a person's body weight is borne by the knees. Even a short time in a kneeling position will prove painful on the knees. Placing a towel or similar item on the floor will help slightly but will not eliminate sore knees.

What is needed is a device whereby a person can be in a kneeling position for a long periods of time without causing the knees to be sore. Such a device should not only cushion the knees but should also relieve the knees from being the only major bearer of body weight when a person is in a kneeling position.

SUMMARY OF THE INVENTION

The present invention provides for a kneeling device that will support an individual when in a kneeling position. The kneeling device consist of a base, an adjustable seat, a non-slip layer, and an optional elbow or arm rest. Located in the front portion of the base is a plurality of grooves. The grooves on the base provide a natural resting place for an individual's knees and a means to prevent shifting. The non-slip layer is located on the bottom surface of the base to provide the base stability when utilized in an area prone to wetness, such as a bathroom. The adjustable seat and the elbow or arm rest are secured to the base by a supporting means.

The unique configuration and design of the kneeling device provides adequate support and comfort for the user. The device is designed in a variety of sizes to accommodate the various sizes of users.

Thus it is the object of the present invention to provide a kneeling device that is comfortable to use.

It is another object of the present invention to provide a kneeling device that provides sufficient amount of support.

It is another object of the present invention to provide for a device which is easy to use, economical to fabricate and durable in operation.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
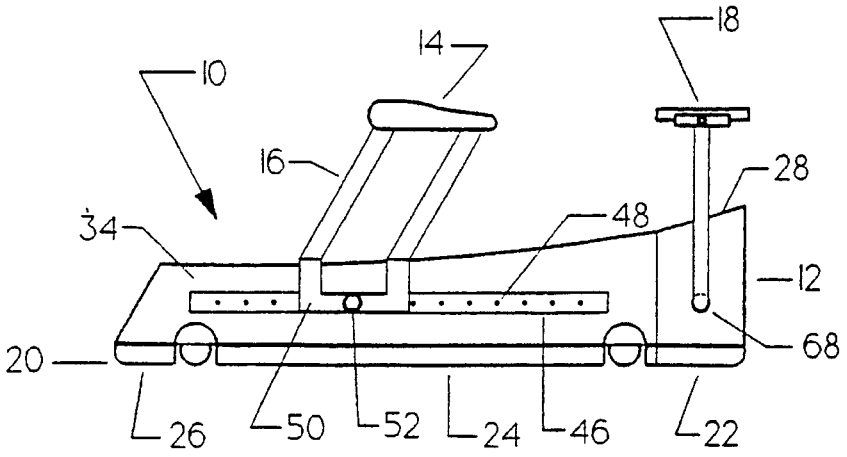
FIG. 1 is a side view of the first embodiment of the kneeling device according to the present invention.
Figure 2:
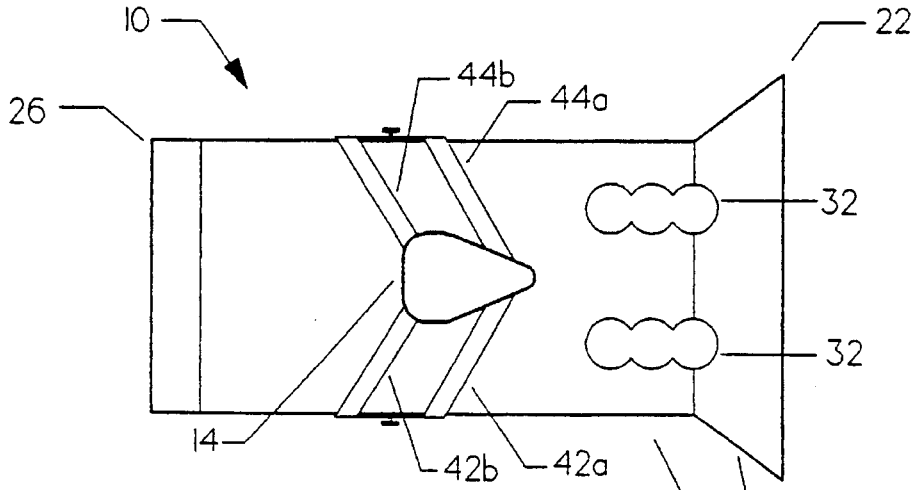
FIG. 2 is a top planar view of the first embodiment of the kneeling device according to the present invention.
Figure 3:
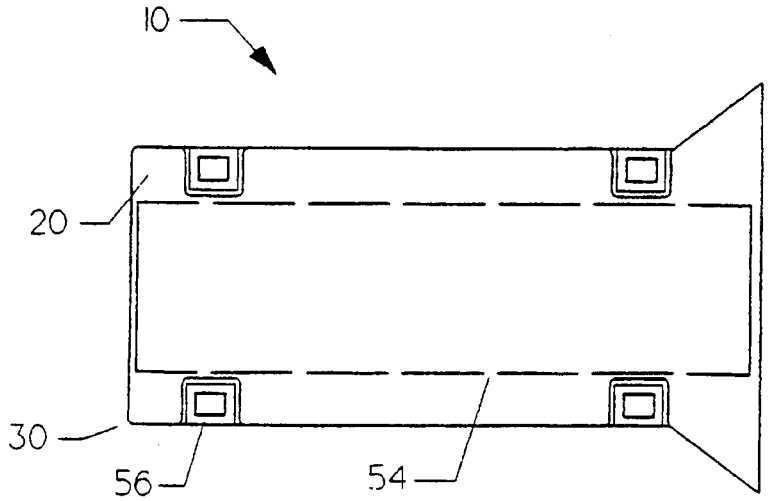
FIG. 3 is a bottom planar view of the first embodiment of the kneeling device according to the present invention.

FIGS. 1–3 illustrate the various views of the kneeling device. As seen in these figures, the kneeling device 10 consists of a base 12, an adjustable seat 14, a supporting means 16 for the adjustable seat, an optional elbow or arm rest 18, and a non-slip layer 20.

As seen from the top planar view of the kneeling device (FIG. 2), the adjustable seat 14 has a triangular shape. However, it is noted that the shape of the seat is not as important as to the structure of the seat. The shape of the seat is purely a matter of design choice.

The seat has a multilayer structure and construction which consists of a metal layer, a resilient material layer, and a waterproof covering. The resilient material, such as latex foam or sponge is situated on the metal layer. Located on the resilient material layer is the water proof material. This water proof material also surrounds the edges of the resilient material layer and metal layers and a portion of the bottom surface of the metal layer.

The base 12 is fabricated from a resilient material, such as latex foam or sponge that can be waterproof. If the resilient material is not waterproof then it is covered with a durable and waterproof material. This base has a front 22, middle 24, and end 26 portion, and a top 28 and bottom 30 surface. The front portion 22 receives the knees of the user, while the adjustable seat is attached to the middle portion of the base by a supporting means. As seen in the figures, the base has a unique shape and design. The front portion 22 gradually increases in thickness and width from the middle portion. This increase in thickness and surface area provides an added cushion in the front end where most of the individual's weight will be placed when the kneeler device is utilized.

On the top surface 28 at the front portion 22 of the base 12 are two rows of circular grooves 32. The grooves provide a natural resting place for an individual's knees and a means to prevent shifting.

The base also includes first, second, third, and fourth sides. The first and second sides are parallel with each other and are dimensionally identical. The first side 34 is illustrated in FIG. 1. The third and fourth sides are parallel with each other. The third side is provided at the front portion of the base while the fourth side is provided at the end portion of the base. Due to the smaller surface area of the top surface with respect to the bottom surface, an inclination exits with the fourth side. This inclination provides a comfortable resting means for the anterior region of the peses or feet. The angle of inclination from the bottom surface to the top surface on the fourth side is approximately, but not limited to, 30 degrees.

A brace 54 is internally located in the base (illustrated in outline in FIG. 3). This brace is situated along the length and the width of the base. The brace is fabricated from any firm and durable material, such as metal.

Channels 46 are located on the first and second sides of the base (only the channel located on the first side of the base is illustrated in FIG. 1). The channels are formed within the brace 54. A plurality of evenly spaced holes 48 are situated within the channel. These holes are for receiving the supporting means for the adjustable seat. Additionally, a first hole 68, is located on the first side, at the front portion, of the base. A second hole is located on the second side, at the front portion, of the base. This second hole is not illustrated in FIG. 1 since the second side is not shown. However, it is noted that this hole is identical is size, shape, and design as the first hole illustrated in FIG. 1. Additionally, the first and second holes are roughened so that the supporting means of the optional elbow or arm rest does not slide or slip.

The first and second holes receive the supporting means for the optional elbow or arm rest. The optional elbow or arm rest is illustrated in further detail in FIGS. *5a–5f*.

Maintaining and securing the seat 14 to the upper surface 28 in the middle portion of the base is a first support 42*a*, a second support 42*b*, a third support 44*a*, and fourth support 44*b*. Each support has a top end and a bottom end. The top end of each support is permanently attached to the bottom portion of the adjustable seat. The bottom ends of the first support 42*a* and the second support 42*b* are attached to the ends of a first bar 50. The bottom ends of the third support 44*a* and the fourth support 44*b* are attached to a second bar. The first and second bars can freely slide within the channels located on the first and second sides of the base.

A first spring loaded knob 52 is centrally affixed to the first bar and a second spring loaded knob is centrally affixed to the second bar. The holes 48 receive the first and second spring loaded knob. The second bar and the second spring loaded knob are not illustrated since the second side of the base is not shown in the figures. However, it is noted that the first bar and the second bar and the first knob and second knob are identical in shape, design, and size.

In order to adjust the seat to a desired location, the first and second spring loaded knobs are pulled out of a hole from their respective channels (first and second channels). This allows the first and second bar, located within the first and second channel to slide freely. The support means (supports, bars, and spring loaded knobs) are slid in the appropriate direction until the desired seat placement is reached. The knobs are then released causing them to be inserted into a hole, thus locking the seat into a fixed position. If the knobs are not directly aligned with one of the holes, a slight adjustment of the support means either backwards or forwards will assure a proper result.

Attached to the bottom surface of the base 12 is a layer of non-slip material 20. This layer 20 is made from a material having a high coefficient of friction. By having a high coefficient of friction, the kneeling device is highly resistive to movement when in use. The non-slip material can be secured to the bottom surface of the base by any conventional attaching means such as the use of adhesives, stitching or lamination. Optionally attached to the bottom surface of the base are four wheel assemblies 56. These wheels provide mobility to the user when utilizing the kneeling device.

A wheel assembly is illustrated in further detail in FIGS. *4a* and *4b*. The wheel assembly 56 consist of a wheel 56*a*, housing 58, shaft 60, spring means 62, J-shaped channels 64, a rod 66, and a housing extension 68 for the spring means. The wheel 56*a* is centrally affixed to the rod 66. The rod 66 is secured to the shaft 60 and the spring means 62 is affixed to the top end of the shaft.

The housing 58 is embedded in the lower surface of the base. Additionally, the housing includes four sides, an enclosed top 61 and an opened bottom 67. A hole 63 is centrally located on the enclosed top 61. This hole 63 receives the top end of the shaft 60 and retains the spring means. A housing extension 68 is located above the housing and protects and covers the spring means 62.

Located on parallel side walls of the housing 58 are J-channels 64. The rod 66 is situated and secured within the J-channels 64 and allows the wheel of each wheel assembly to be utilized or stored within the housing.

In order to utilize the wheel assemblies, the wheels are lowered from the straight portion 69 of the J-channels and are relocated to the curved portion 65 of the J-channels. If the wheel assemblies are not desired, then the wheels are relocated from the curved portion to the top of the straight portion of the J-channel.

FIGS. *5a–5f* illustrate the enlarged and detailed views of the optional elbow or arm rest. As illustrated the arm or elbow rest 18 consist of a main tray 70, attachable and detachable side trays 72, and supporting means 76 for the elbow or arm rest.

As illustrated in these figures, the supporting means 76 has a first end 84 and a second end 86. The first end is permanently attached to the bottom surface of the main tray 70, while the second end 86 is received in the first and second holes located on their respective sides (first and second sides) of the base (illustrated in FIG. 1), one end in each hole. Additionally, the first end receives the second end. This will provide for the supporting means 76 with a telescopic effect so that the height of the elbow or arm rest can be adjusted.

The first end 84 of each of the supporting means 76 is provided with a pluralities of evenly spaced holes 82. Each second end is provided with a spring loaded button 80. The first end, second end, spring loaded button, and pluralities of holes provides for a height adjusting means. In order to adjust the height of the elbow or arm rest 18 the button 80 is pressed and the first end slides freely over the top end. The button emerges at first available hole located on the first end, thus locking the arm or elbow rest in place. If that height is not desirable, then the process is continued until the desired height is obtained.

Figure 5A:
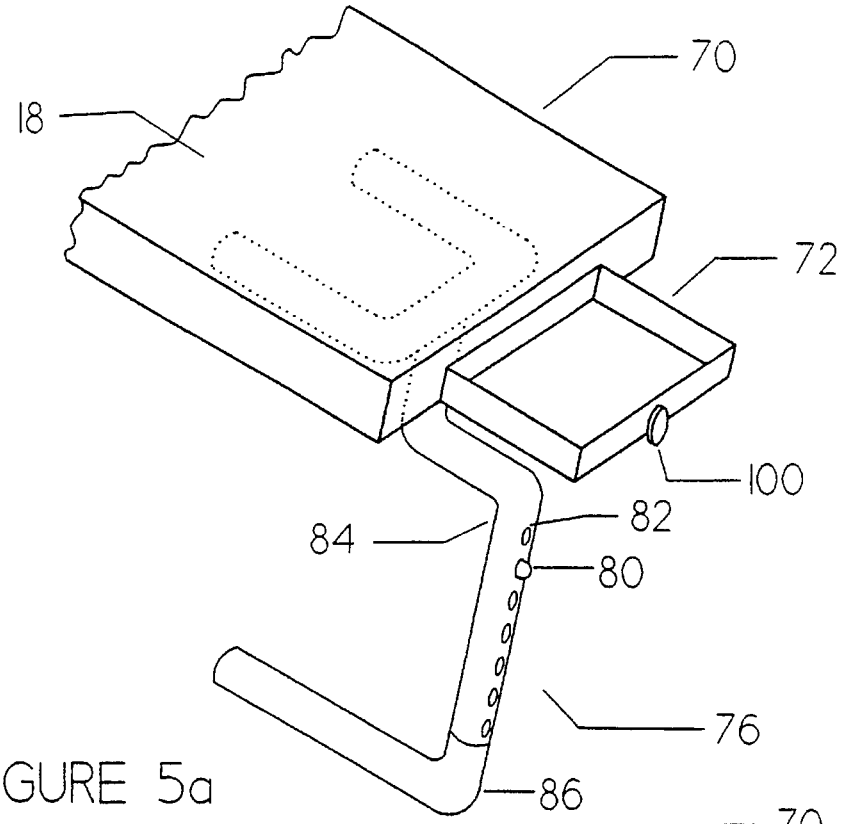
FIG. 5*a* is a partial perspective view of the elbow or arm rest used in the kneeling device of the first and second embodiments of the present invention.
Figure 5B:
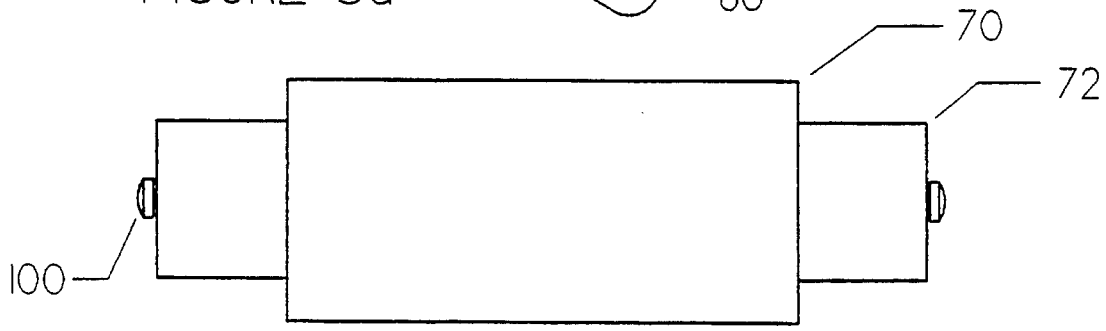
FIG. 5*b* is a top planar view of the elbow or arm rest used in the kneeling device of the first and second embodiments of the present invention.
Figure 5C:
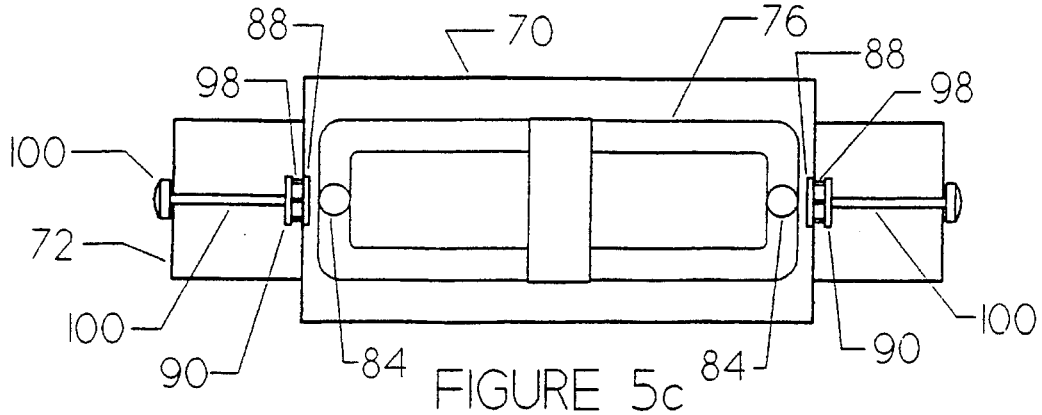
FIG. 5*c* is a bottom planar view of the elbow or arm rest used in the kneeling device of the first and second embodiments of the present invention.

As illustrated in FIG. 5*c*, the bottom planar view of the main tray, the supporting means 76 extends across the entire length and width of the bottom surface of the main frame.

The two side trays 72 are attachable and detachable to and from the main tray. The pitch of each side tray can be adjusted with respect to the main tray by a rotating means. The rotating means consist of a first circular plate 88, a second circular plate 90, bars 98, and an elongated spring loaded knob 100. The first circular plate 88 is permanently attached to the main tray. The first plate 88 includes a first central aperture 92 (see FIGS. 5*e* and 5*f*). A plurality of evenly spaced apart holes 94 are located along the edge of the first plate 88.

The second circular plate is permanently attached to the elongated spring loaded knob. The spring loaded knob and the second plate are permanently attached to the bottom surface to each of the side trays. The second plate includes a second central aperture 96 (see FIGS. 5*e* and 5*f*). Three evenly spaced extended bars 98 are located along the edge of the second plate. The bars 98 are received by the plurality of holes located in the first plate 88.

An elongated spring loaded knob 100 extends from the second central aperture of the second plate to first central aperture of the first plate. In order to attach and adjust the pitch of the trays, the spring loaded knob is pulled to release the three extended bars from their respective holes 94. This allows free rotation of the trays. Once the desired pitch is obtain, the spring loaded knob is released and the extend bars are inserted into the appropriate holes, thereby locking the side trays in place.

Figure 5D:
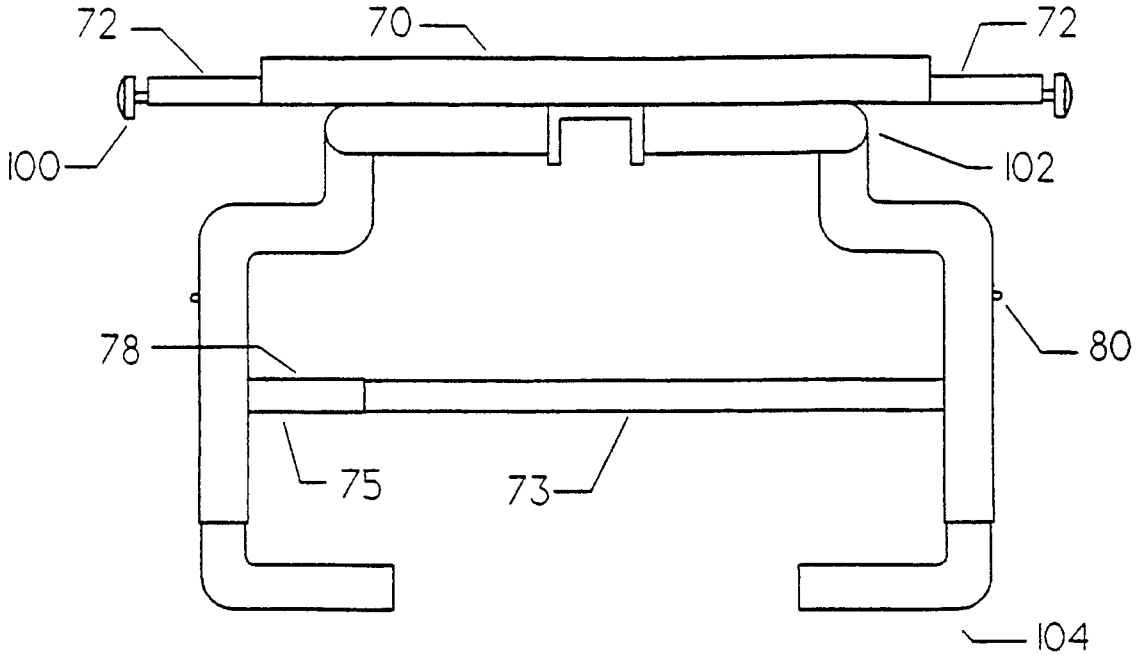
FIG. 5*d* is a side view of the elbow or arm rest used in the kneeling device of the first and second embodiments of the present invention.
Figure 5E:
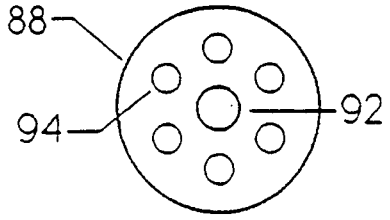
FIG. 5*e* is front view of a first plate used in the elbow or arm rest according to the kneeling device of the present invention.
Figure 5G:
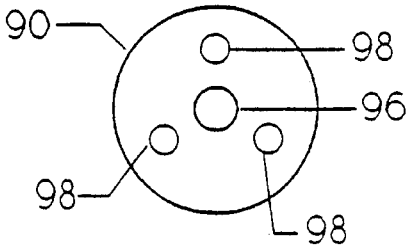
FIG. 5*g* is a front view of a second plate used in the elbow or arm rest.
Figure 5F:
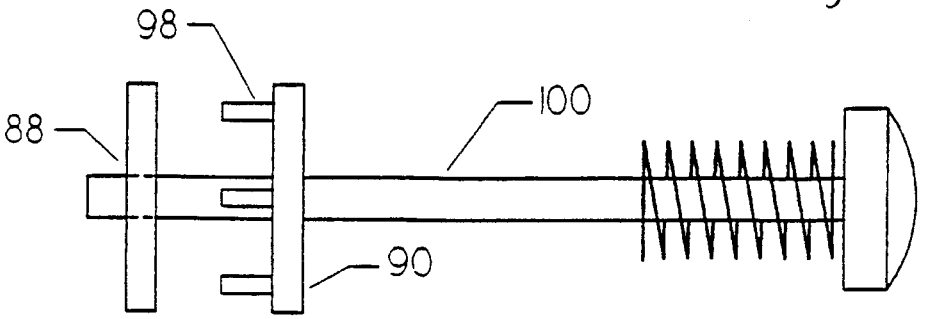
FIG. 5*f* is a side view of an elongated knob used in the elbow or arm rest according to the kneeling device of the present invention.

The elbow or arm rest can also be provided with a towel rack 78 which extends across the supporting means (see FIG. 5*d*). The towel rack has a first end 73 and a second end 75. The first end is received in the second end which allows the first end to slide freely within the second end. This sliding telescopic arrangement provides for the towel rack to slide when the elbow or arm rest is attached to the base.

In order to attach the elbow or arm rest to the base, the supporting means are pulled outward and are inserted into the first and second holes of the base.

Additionally, the two side trays can be permanently affixed to the main tray. By being permanently affixed to the main tray, the two side trays will remain secured and stationary.

Figure 6:
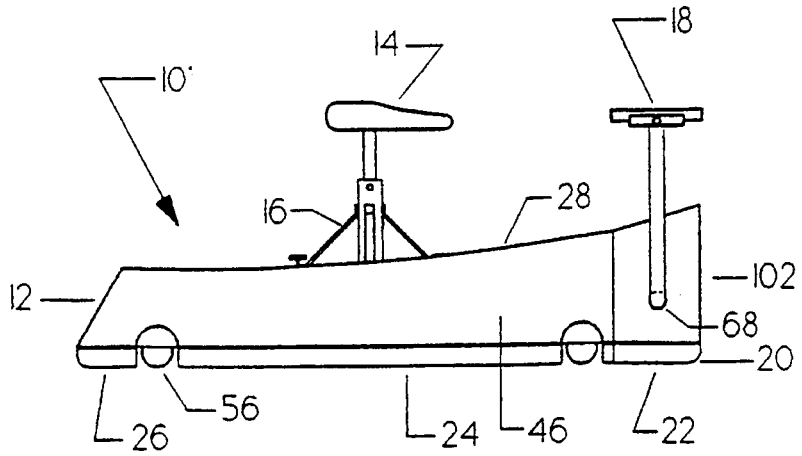
FIG. 6 is a side view of the second embodiment of the kneeling device according to the present invention.
Figure 7:
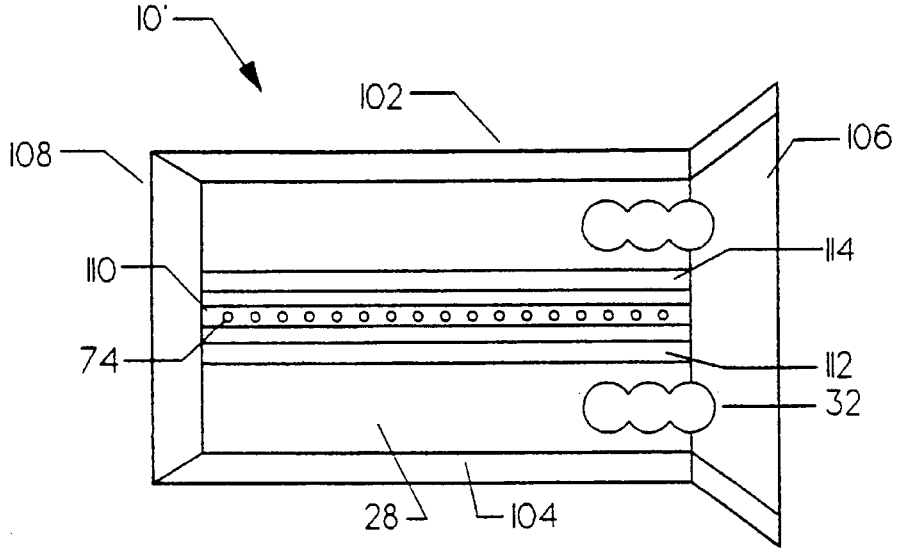
FIG. 7 is a top planar view of the base of the second embodiment of the kneeling device according to the present invention.
Figure 8:
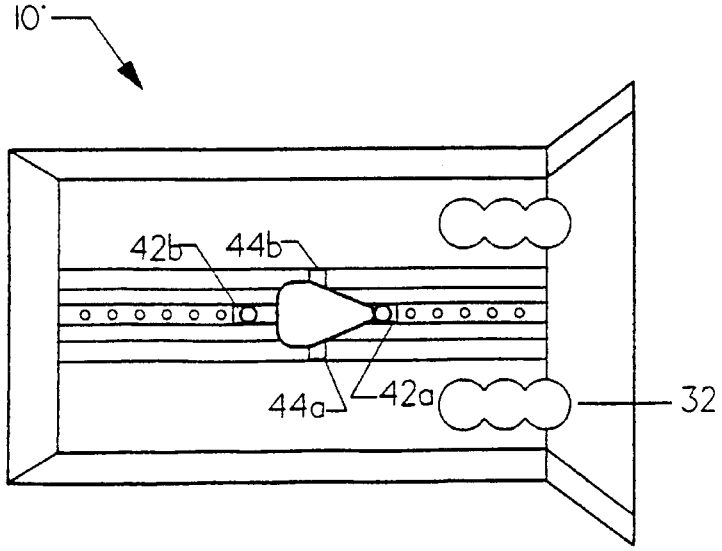
FIG. 8 is a top planar view of the second embodiment of the kneeling device according to the present invention.

A second embodiment of the kneeling device is illustrated in FIGS. 6–8. As illustrated in the figures, second embodiment of the kneeling device 10' consists of a base 12, an adjustable seat 14, a supporting means 16 for the adjustable seat, an optional elbow or arm rest 18, and a non-slip layer 20.

The base 12 is fabricated from a resilient material, such as latex foam or sponge that can be waterproof. If the resilient material is not waterproof then it is covered with a durable and waterproof material. This base has a front 22, middle 24, and end 26 portion, and a top 28 and bottom 30 surface. The front portion 22 receives the knees of the user while the adjustable seat is attached to the middle portion of the base by a supporting means 16. As seen in the figures, the base has a unique shape and design. The top surface 28 has a smaller surface area than the bottom surface 30. This is to provide stability when the device is in use and operation. The front portion 22 gradually increases in thickness and width from the middle portion. This increase in thickness and surface area provides an added cushion in the front portion where most of the individual's weight will be placed when the kneeler device is utilized.

On the top surface 28 at the front portion 22 of the base 12 are two rows of circular grooves 32. The grooves provide a natural resting place for an individual's knees and a means to prevent shifting.

Located in the center of the top surface of the base is a first channel 110, a second channel 112, and a third channel 114. As illustrated, these channels are parallel to each other and only the first channel 110 is provided with a plurality of holes 74 that are evenly spaced apart. These holes receive the supporting means 16 and provide a means of adjusting the location of seat.

The base also includes a first 102, second 104, third 106, and fourth 108 sides. The first and second sides are parallel with each other and are dimensionally identical. The third and fourth sides are parallel with each other. The third side 106 is provided at the front portion 22 of the base while the fourth side 108 is provided at the end portion 26 of the base. Due to the smaller surface area of the top surface with respect to the bottom surface, an inclination exits with the fourth side. This inclination provides a comfortable resting means for the anterior region of the peses or feet. The angle of inclination from the bottom surface to the top surface is approximately, but not limited to, 30 degrees.

Located on the first side and the second side at the front portion of the base are holes 68 (the hole 68 located on the second side of the base is not illustrated). These holes are used for receiving the support means for the optional elbow or arm rest 18. In addition, these holes are roughened in order to secure the supporting means for the optional elbow or arm rest without any slippage. The optional elbow or arm rest is illustrated and discussed in detail in FIGS. 5*a*–5*f*.

Maintaining and securing the seat 14 to the upper surface 28 in the middle portion of the base are supports 42*a*, 42*b*, 44*a* and 44*b*. The supports 42*a*, 42*b*, 44*a*, and 44*b* are illustrated and discussed in further detail in FIGS. 9, 10, 14*a*, and 14*b*.

Figure 4A:
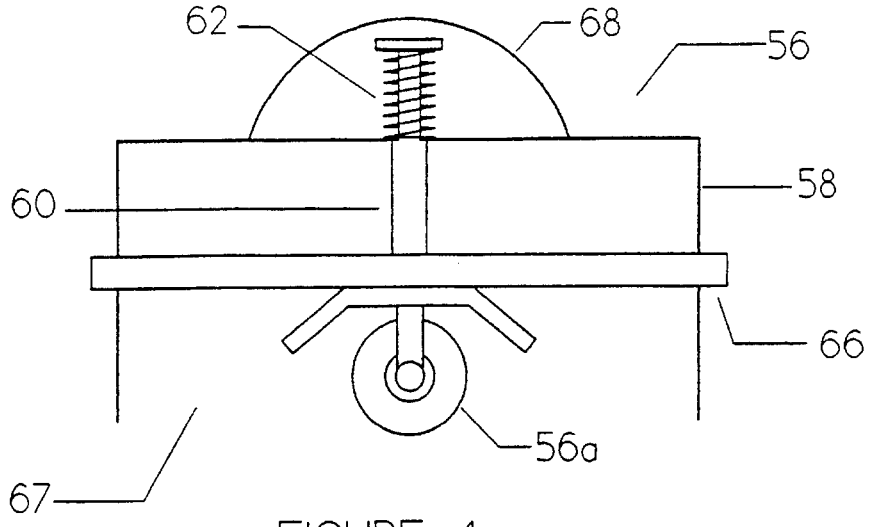
FIG. 4*a* is a perspective view of the housing used in the wheel assembly of the present invention.
Figure 4B:
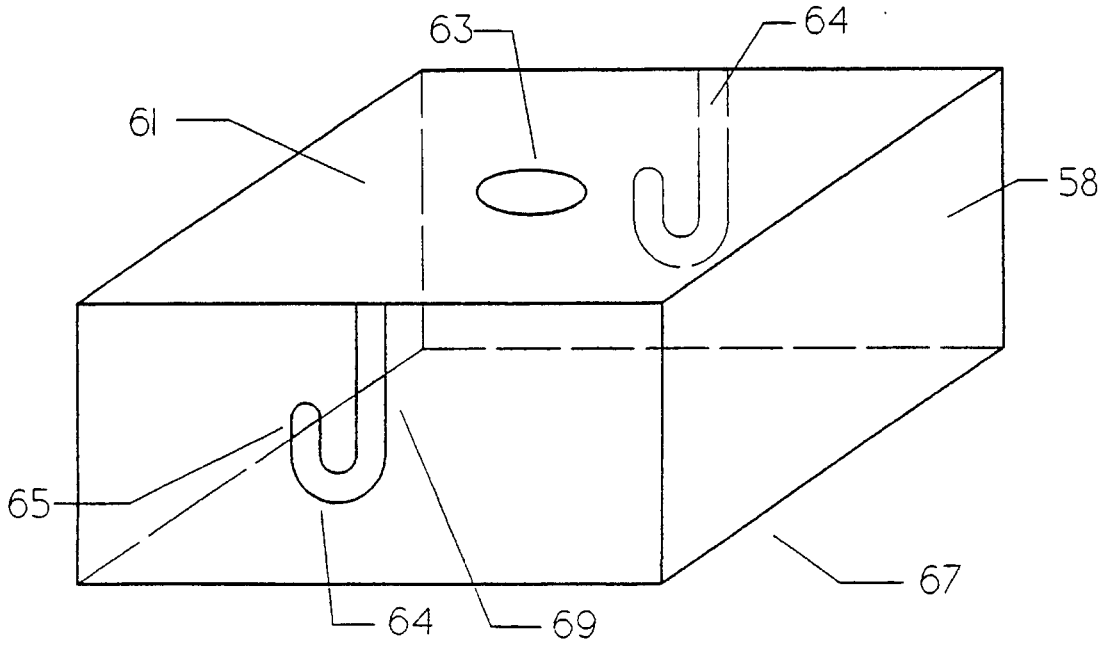
FIG. 4*b* is a side view of the wheel assembly used in the kneeling device in the present invention.

Attached to the bottom surface of the base 12 is a layer of non-slip material 20. This layer 20 is made from a material having a high coefficient of friction. By having a high coefficient of friction, the kneeling device is highly resistive to movement when in use. The non-slip material can be secured to the bottom surface of the base by any conventional attaching means such as the use of adhesives, stitching or lamination. Optionally attached to the bottom surface of the base are four wheel assemblies. These wheels assemblies are identical to the ones described and illustrated in FIGS. 4*a* and 4*b*.

A brace is internally located in the base. This brace is identical in structure as the brace illustrated in outline in FIG. 3 of the first embodiment. This brace is situated along the length and the width of the base. The brace can be fabricated from any firm and durable material, such as metal.

Figure 9:
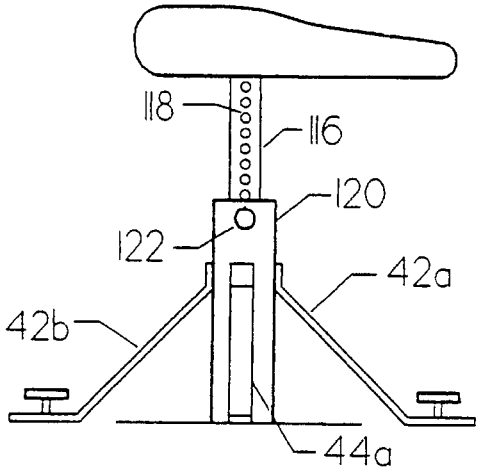
FIGS. 9 and 10 are various views of the height adjustment means for the seat of the second embodiment of the kneeling device according to the present invention.
Figure 10:
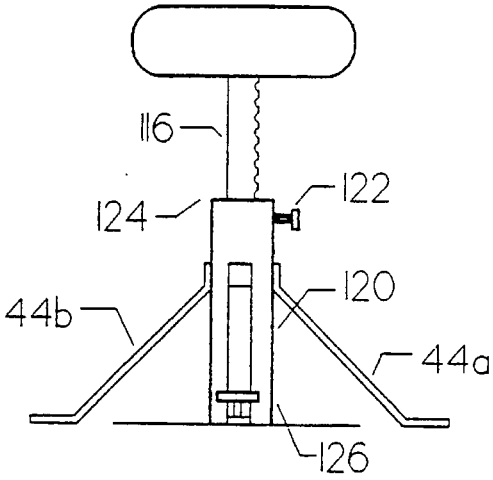

The height of the seat can be altered by a height adjusting means. This height adjusting means is illustrated in FIGS. 9 and 10. As seen, the height adjusting means consist of a pole 116, a tube 120, and a spring loaded knob 122. The pole has a first end and a second end. The first end is affixed to the bottom of the seat while the second end is received in the tube. The pole also contains a plurality of holes 118 that are evenly spaced apart.

The tube has a top area 124 and a bottom area 126. The top area 124 receives the pole 126. Also located in the top area 124 of the tube is the spring loaded knob 122. The holes 118 of the pole receives the spring loaded knob. The bottom area 126 sits in the first channel and can slide freely within the channel.

To adjust the height of the seat, the knob 122 is pulled out of a hole from the pole to allow the seat to freely be raised or lowered. Once the desired height is reached, the knob is released, causing it to be inserted into a hole, thus locking the seat into a fixed position.

Figure 11:
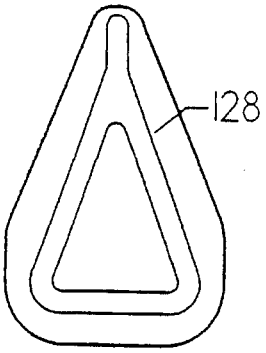
FIG. 11 is a bottom view of the seat used in the second embodiment of the kneeling device of the present invention.
Figure 12:
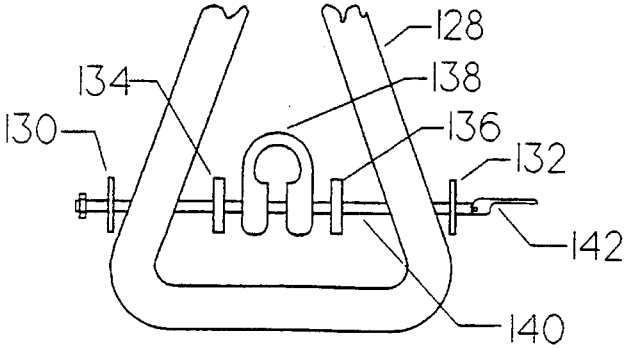
FIG. 12 is a bottom view of the seat's pitching means used in the second embodiment of the kneeling device of the present invention.
Figure 13:
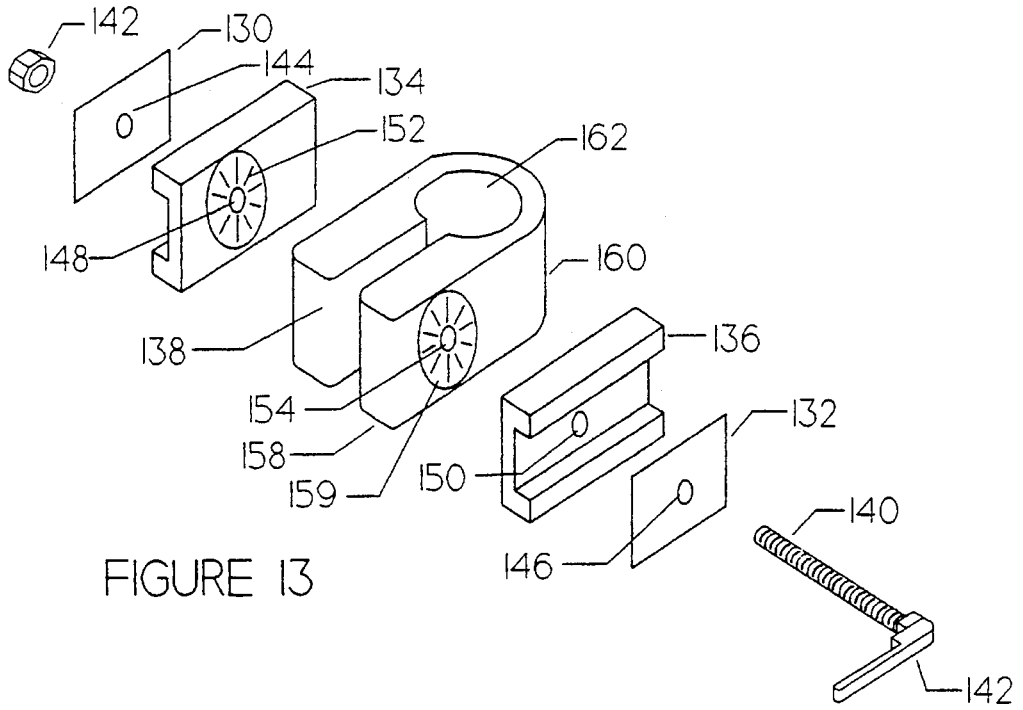
FIG. 13 is a perspective view of the seat's pitching means used in the second embodiment of the kneeling device of the present invention.

The seat in the second embodiment is provided with a pitching means. The pitching means is illustrated in FIGS. 11–13. The bottom planar view of the adjustable seat is illustrated in FIG. 11. As this figure illustrates, two elongated metallic bars 128 are attached to the bottom of the adjustable seat. First and second holes (not illustrated) are located on the elongated metallic bars. Located on the outside of each bar is a first plate 130 and a second plate 132. A third hole 144 is centrally located on the first plate 130 and a fourth hole 146 is centrally located on the second plate 132. The third and fourth holes are aligned with the first and second holes.

Located on the inside of the elongated rods are a third metal plate 134 and a fourth metal plate 136. A fifth hole 148 is centrally located on the third plate 134 and a sixth hole 150 is located on the fourth metal plate 136. The fifth and sixth holes are aligned with the first and second holes.

The third metal plate has a first side and a second side. The first side faces the first metal plate. The second side is provided with a plurality of grooves or indentations 152. These grooves or indentations 152 have a circular configuration.

The fourth metal plate has a first side and a second side. The first side faces the first metal plate. The second side is provided with a plurality of grooves or indentations (not illustrated but are the same shape, design and structure as the grooves and indentations on the third metal plate). These grooves or indentations have a circular configuration. The configuration provided on the third metal plate is aligned with the configuration provided on the fourth metal plate.

An U-shape metal plate 138 is provided between the third and fourth metal plate. This U-shape metal plate 138 has a first end 158 and a second end 160. The first end has a first side and a second side. The first side faces the third plate (this first side is not illustrated) and the second side faces the fourth plate. A seventh hole 154 and an eighth hole are centrally located in the first and second side, respectfully. The seventh and eighth holes are aligned with the first and second holes. Also located on the first and the second side of the U-shape metal plate is a plurality of indentations or grooves having a circular configuration 159. Each of these circular configurations on the U-shape metal plate corresponds to the circular configuration located on the third and fourth plate.

A rod 140 passes through the first, second, third, fourth, fifth, sixth, seventh, and eighth hole which extends from the first plate to the second plate. This rod is attached to a conventional quick released mechanism 142.

The second end 160 of the U-shape plate has an opening 162 which receives the top end of the pole (discussed and illustrated in FIGS. 9 and 10).

In order to adjust the pitch of the seat, the quick release knob is turn. This loosens the U-shape, third, and fourth plate. Once loosened, the U-shape plate is free to rotate with respect to the third and fourth plate. This movement about third and fourth plate provides for the seat to be move and thus changes the pitch. Once the desired pitch is reached the quick release knob is locked into position. This maintains and secures the desired pitch for the seat.

The seat can also be moved backward or forward. This is done by moving the supports along its respective channel. Supports 42*a* and 42*b* are maintain within the first channel. Additionally, support 44*a* is maintained within the second channel. Finally, support 44*b* is maintained within the third channel. The supports of the second embodiment of the present invention are provided with an unique construction and design. The supports maintained in the first channel are identical to each other, while the supports maintained in the second and third channels are identical to each other. Since the first support is identical in construction and design with the second support and the third support is identical in constitution and design, then only two supports will be illustrated in further detail in FIGS. 14*a* and 14*b*.

Figure 14A:
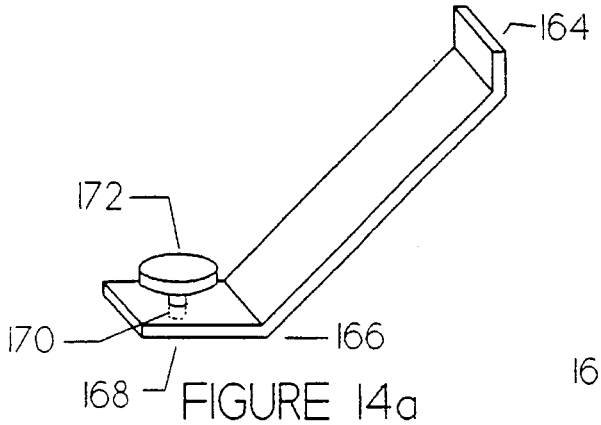
FIG. 14*a* is a side view of a support that is received in the first channel used in the second embodiment of the kneeling device of the present invention.
Figure 14B:
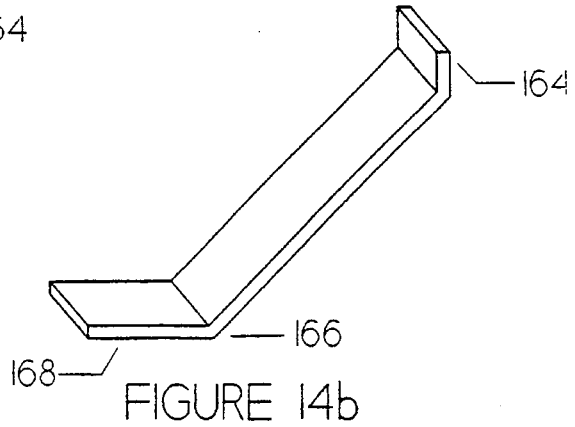
FIG. 14*b* is a side view of a support that is received in either the second or third channel used in the second embodiment of the kneeling device of the present invention.

As seen in FIGS. 14*a* and 14*b*, the supports have two configurations. Each support has a first end 164 and a second end 166. Each support is shaped and configured to have a rectangular cross-section. However, this shape or configuration can include, but not be limited to, a circular cross-section, a square cross-section or an oval cross-section.

The first ends of the supports are permanently secured and affixed to the tube of the height adjusting means (illustrated in FIGS. 9 and 10).

The second end of the support consist of an outwardly extending flange 168. It is this flange that is maintained in the respective channel. The supports that are maintained in the first channel is further provided with an aperture 170 within the flange. This aperture receives and secures a spring loaded knob 172. This knob is also received within a hole of the first channel (illustrated in FIG. 8).

In order to adjust the seat, the knobs are pulled out of the holes of the first channel to allow the seat to move backwards and forwards, along a horizontal path. Once the desired location of the seat is obtained, the knobs are released, causing it to be inserted into the holes of the first channel, thereby locking the seat into a fixed position.

While the invention has been particularly shown and described with reference to an embodiment thereof, it will be understood by those skilled in the art that various changes in form and detail may be made without departing from the spirit and scope of the invention.

I claim:

1. A kneeling device comprising:

a) a generally rectangular-shaped base having a front portion, a back portion, a top surface, a bottom surface, a first side, a second side, a third side, and a fourth side;

b) a brace extending from the front portion to the back portion and from the first side to the third side;

c) a seat;

d) an elbow or arm rest;

e) a first support means to support the elbow or arm rest to the base at the front portion;

f) a first channel, having a plurality of spaced apart holes, located in the first side and formed in the brace and a second channel, having a plurality of spaced apart holes, located in the third side and formed in the base;

g) a first bar slidably located within the first channel and a second bar slidably located within the second channel;

h) a first spring-loaded knob attached to the first bar and a second spring-loaded knob attached to the second bar;

i) a second support means, having a first support, a second support, a third support, and a fourth support, to support the seat to the base such that one end of the first support is attached to the first bar and the opposite end is attached to the seat, one end of the second support is attached to the first bar and the opposite end is attached to the seat, one end of the third support is attached to the second bar and the opposite end is attached to the seat, one end of the fourth support is attached to the second bar and the opposite end is attached to the seat; and wherein the seat is displaced by pulling on the first spring-loaded knob and the second spring-loaded knob, moving the seat back or forth and thereafter releasing each spring-loaded knob such that the first spring-loaded knob is inserted into one of the spaced part holes of the first channel and the second spring-loaded knob is inserted into one of the spaced apart holes of the second channel.

2. The device as in claim 1 to further include a plurality of grooves provided on the top surface for receiving the knees of a user.

3. The device as in claim 1 wherein the base is waterproof.

4. The device as in claim 1 wherein the seat has height adjustment means.

5. The device as in claim 1 wherein the seat has a pitching means.

6. The device as in claim 1 wherein a non-skid layer is attached to the bottom surface of the base.

7. The device as in claim 1 wherein the elbow or arm rest includes a main tray, a first side tray, and a second side tray.

8. The device as in claim 7 wherein the first side tray and the second side tray each have a pitching means.

* * * * *